United States Patent [19]

Church

[11] 4,318,748

[45] Mar. 9, 1982

[54] CONTINUOUS PROCESS FOR SACCHARIFICATION OF WHOLE STARCHY MATERIALS

[75] Inventor: John A. Church, Princeton Junction, N.J.

[73] Assignee: American Can Company, Greenwich, Conn.

[21] Appl. No.: 138,692

[22] Filed: Apr. 9, 1980

[51] Int. Cl.[3] ..... C13K 1/06

[52] U.S. Cl. ..... 127/38

[58] Field of Search ..... 127/28, 38

[56] References Cited

U.S. PATENT DOCUMENTS

| | | | |
|---|---|---|---|
| 2,148,016 | 2/1939 | Gale | 127/28 |
| 2,359,763 | 10/1944 | Horesi | 127/38 |
| 2,393,095 | 1/1946 | Fetzer | 127/38 |
| 2,954,304 | 9/1960 | Kroyer | 127/38 |
| 3,424,613 | 1/1969 | Huber et al. | 127/38 |
| 4,137,094 | 1/1979 | Hughes | 127/28 |
| 4,221,609 | 9/1980 | Hughes | 127/28 |

*Primary Examiner*—Peter Chin

*Attorney, Agent, or Firm*—Robert P. Auber; Stuart S. Bowie; Ernestine C. Bartlett

[57] ABSTRACT

A continuous process is provided for effecting the acid hydrolysis of whole grains, e.g., corn, at high solids and in an economically desirable manner. The process produces glucose which is readily fermentable to produce ethanol.

7 Claims, 1 Drawing Figure

CONTINUOUS PROCESS FOR SACCHARIFICATION OF WHOLE STARCHY MATERIALS

BACKGROUND OF THE INVENTION

1. Prior Art

The prior art is believed to be exemplified by the following:

Dreyfus; U.S. Pat. No. 2,086,701; 7/37
Burns; U.S. Pat. No. 2,233,243; 2/41
Kroyer; U.S. Pat. No. 2,954,304; 7/57
Graham; U.S. Pat. No. 3,692,530; 9/72
Funk et al; U.S. Pat. No. 3,523,911; 8/70
Ramos-Rodriguez; U.S. Pat. No. 3,701,789; 10/72
Jaffe et al; U.S. Pat. No. 3,784,408; 1/74
Algeo; U.S. Pat. No. 3,817,786; 6/74
Knauth; U.S. Pat. No. 4,023,982; 5/77
Kiminki et al; U.S. Pat. No. 4,029,515; 6/77
Fann; U.S. Pat. No. 4,072,538; 2/78
483,431 (Russia) 12/75
Dunning et al, "The Saccharification of Agricultural Residues", *Industrial and Engineering Chemistry*, pp. 24–29, January, 1945.
Church et al, U.S. patent application Ser. No. 2,885 filed 1/12/79—"Continuous Process for Cellulose Saccharification";
Faber et al, U.S. patent application Ser. No. 053,979 filed 7/2/79—"Fermentable Acid Hydrolyzates and Fermentation Process".
Burroughs et al, Ser. No. 2,886 filed 1/12/79—"Reactor System and Pump Apparatus Therein".

2. Field of the Invention

It is now known that lignocellulosic constituents of used wood, paper and agricultural byproducts such as sawdust, newspaper, corncobs, straw, sugar cane bagasse, etc. may be converted into hydrolyzates suitable for use as the raw fermentable substance to convert sugar into ethyl alcohol.

With the advent of gasohol and the increasing need for alternatives to petroleum based fuels, there is an increasing need for methods by which abundant and renewable resources may be converted into alternative fuels.

In U.S. application Ser. No. 2,885 filed Jan. 12, 1979 of Church et al entitled "Continuous Process For Cellulose Saccharification" and commonly assigned herewith, there is described a method and apparatus for saccharification of cellulosic products in which the polysaccharide constituents of typical waste products may be converted into glucose and either furfural or xylose. Such a process conveniently, rapidly and economically provides by acid cellulose hydrolysis, a hydrolyzate which contains glucose fermentable to ethanol.

Although such method has been made available for conversion of cellulosic materials, no similar advances have heretofore been made for the like conversion of whole starchy materials.

Starchy materials have heretofore been converted to sugars by acid hydrolysis or by enzymatic action. For example, corn syrup is conventionally produced by acid hydrolysis. However, in such conventional processes, it is customary to first separate out the non-starchy components of the corn and employ only pure starch as a reactant to avoid a deleterious browning effect caused by the well known Maillard reaction which arises when glucose is acted upon by acid in the presence of protein. Acid hydrolysis of pure starch is known to produce good yields in both batch and continuous processes but, because of the inability to use other than pure starch starting material, the method lacks versatility and is expensive. Even when pure starch is the starting material, known acid hydrolysis technology cannot produce a glucose yield of better than 88% when starch concentrations of around 20% are used. The glucose loss in this case is not due to the Maillard reaction, as no amino acids are present, but rather to the acid-catalyzed reversion and degradation reactions of the glucose. Nearly theoretical yields can be obtained at very low starch concentrations; however use of such low concentrations is commercially impractical due to high dilution of the glucose.

Starch has also been hydrolyzed by an enzymatic method wherein whole grain or pure starch is converted to corn syrup, crystalline glucose or fermentable sugars by enzyme action in batch processes. Such methods result in high yields and provide versatility in terms of suitable starting materials. However, such methods suffer from the disadvantage of being extremely slow, requiring anywhere from 1 to 4 days per reaction cycle. Moreover, such methods require the extra expense of separate and complex equipment for enzyme generation or processing necessitating large and elaborate plants.

It is an object of this invention to provide rapid, efficient and economical means for converting starchy materials to glucose.

Another object of the invention is to provide a versatile process in that low-quality grain and/or readily accessible agricultural starchy materials may be employed without preliminary processing to isolate pure starch.

Yet another object of the invention is to provide a method for rapidly and efficiently producing fermentable sugars from readily available low-quality grain or other starchy materials, which sugars may be produced employing the same apparatus previously employed to convert cellulosic material to fermentable sugars.

These and others objects of the invention will be apparent from the description of the invention which follows.

SUMMARY OF THE INVENTION

The foregoing and related objects are readily attained in a continuous process for the saccharification of starchy materials utilizing, as the feedstock, such a material containing from about 50 to 65% whole grain solids or about 15 to 25% tuber solids. The mixture is substantially continuously introduced into one end of a tubular reactor, while the other end of the reactor is constricted so as to develop a back pressure therein. A strong mineral acid is admixed with the starchy material in a concentration appropriate to catalyze the hydrolysis thereof, and steam is substantially continuously injected into the mixture at a location immediately downstream from the beginning of the reactor. At or near the same point, liquid water may be simultaneously injected. The steam produces a reaction mass containing from about 15 to 35 weight percent solids in the case of whole grain materials and from about 10 to 20 weight percent solids in the case of tuber materials such as potatoes, the steam being injected in an amount sufficient to maintain the temperature of the reaction mass at about 160° C. to about 210° C. to thereby effect hydrolysis of the material in the presence of the acid. Thereafter, the reaction mass is substantially continuously passed into and through a reaction zone of the reactor, located downstream from the steam injection location. The length of the reaction zone and the rate of feed mixture introduction are so selected and controlled as to afford an average residence time of about 1 to 10 minutes and preferably about 3 to 5 minutes for each increment of the reaction mass in the reaction zone, with the back pressure therewithin being about 100 to 280 pounds per square inch guage. Finally, the reaction mass is substantially continuously discharged from the reactor, and the products of saccharification are either recovered therefrom or fed directly to a fermenter for production of ethanol.

Normally in the discharging step of the process, the reaction mass will be subjected to an abrupt pressure reduction (with or without auxiliary cooling), thereby cooling the mass and terminating the reactions.

The hydrolyzate, most desirably, will be neutralized to a pH of about 4 to 7, and generally calcium carbonate will be utilized for that purpose. Precipitated solids are normally present in only small amounts and need not be removed unless they interfere with the fermentation operation. The hydrolyzate may be fermented, without the necessity of further preconditioning, preferably by introducing yeast into the hydrolyzate under conditions suitable to produce ethanol.

Typically, the acid employed as the catalyst for the process will be sulfuric and will produce an apparent pH in the reaction mass of less than about 1. Preferably the acid will be admixed substantially continuously, and at or immediately adjacent to the location at which the steam is injected.

GENERAL DISCLOSURE

Figure 1:
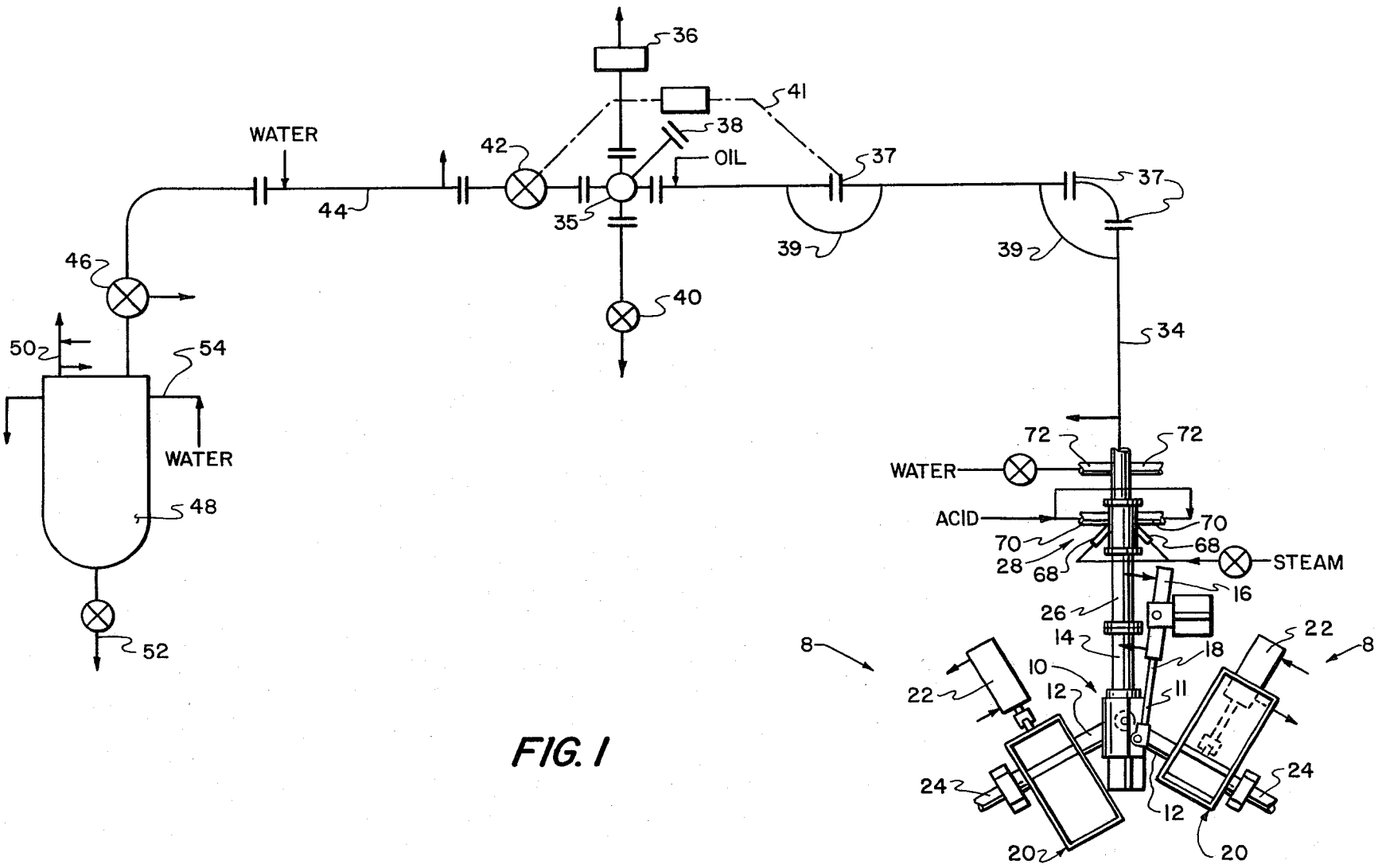
FIG. 1 is a schematic illustration of a reactor system suitable for use in carrying out the process of the present invention.

The method of the invention is preferably conducted in a pipe type reactor as described in copending U.S. application Ser. No. 2,885 filed Jan. 12, 1979. Such a reactor, for example, may be a 1½ inch inside diameter pipe reactor 34 feet in length and 0.48 cubic foot in volumetric capacity, fitted with a pressure responsive valve at its discharge end, controlled by a loop circuit to maintain a desired pressure in the reaction zone. Introduction of starchy material may be substantially continuous from an inlet section of the reactor using a high solids reciprocating pump.

Acid is continuously injected at a rate sufficient to maintain a concentration of about 1–2%, based upon the total contents of the reactor. Steam is injected at a rate sufficient to maintain the desired temperature in the reaction zone, and hydrolyzed material is passed through a cooling section of the system into a cooling tank equipped with a reflux condenser, or into an open collection tank, if desired.

The hydrolyzate is neutralized to a pH of about 4 to 7, filtered, if desired, and the resulting sugar solution is ready for fermentation to ethanol, and other end products.

Hydrolyzate Raw Material

The invention may be successfully realized by acid hydrolysis of starchy materials. Such starchy materials may be derived from low-cost, off-grade, i.e., moldy or old, grain or from other starchy agricultural products that cannot be used for human or animal consumption due to the presence of aflatoxins or other toxic and undesirable products of mold growth. Of course, higher quality starchy products may also be used. Whole grain and tubers of any condition including corn, rice, rye, barley, milo (grain sorghum), oats, millet, wheat, tapioca, sweet potatoes, yams, white potatoes, cassava, etc. may be employed as starting materials.

The preparation of suitable feedstock from such starchy materials may be accomplished by largely mechanical means such as grinding, chopping, cutting, etc. to break down the cellular structure. In the preferred embodiment of the invention, the only treatments required prior to hydrolysis are mechanical size reduction to about 1/32 to 3/32 inch particles in the case of grain kernals. Such size reduction serves to fracture the kernals and expose the starchy interiors for hydrolysis. Moisture content may also be adjusted, if necessary, to allow proper pumping by the ram pump system described hereinbelow. Tuber materials such as potatoes need only be chopped to about ¾ inch particle size.

Starch is insoluble in cold water, but when heated with water, the granules burst and the starch partly diffuses into the water to form a colloidal solution. There are two fractions: amylose and amylopectin. Amylose is believed to be straight chain simple starch, built up of 1,4-$\alpha$ linked D-glucose units. Amylopectin is believed to have, in addition to the characteristic amylose structure, frequent 1,6-$\alpha$ branches. Hydrolysis of both fractions proceeds through a succession of progressively less complex substances called dextrins to the final sugar, glucose.

In general, acid hydrolysis is achieved, in the presence of steam, of a starchy material feedstock having a solids content as introduced of from about 50 to 65 weight percent whole grain solids or about 15 to 25 weight percent potatoes or tuber solids at temperatures within the range of about 160° C. to 210° at pressures of about 100 to 280 pounds per square inch gauge with residence times in the reaction zone of about 1 to 10, and preferably 3 to 5 minutes. In the reaction mass the optimum amount of water after steam and auxiliary water injection is about 60 to 90 weight percent and virtually any strong mineral acid can be employed to catalyze the hydrolysis, with sulfuric acid being normally the acid employed in amounts of about 1 to 2 percent based on the total weight of the reaction mass.

DETAILED DESCRIPTION OF THE PREFERRED EMBODIMENT

Turning in detail to the drawing, there is illustrated schematically a reactor system suitable for use in practicing the process of the invention comprising a high solids pump connected to a jacketed pipe reactor through a buffer zone and a steam and acid injection block, all to be described in greater detail; the reactor is relieved into a product collection tank, which also will be more fully described.

The pump section, generally designated by the numeral 8, consists of a ball valve unit, generally designated by the numeral 10, the ball 11 of which has formed therethrough a single, accurately-machined, uniform-diameter curved channel (not seen in FIG. 1), so located as to provide communication alternately between one of the feed barrels 12 and the outlet pipe 14 extending therefrom. The ball 11 of the valve 10 is mounted for rotation to alternatingly register its channel with one of the barrels 12, and it is so driven by the hydraulic cylinder 16, through the piston rod 18 thereof.

The pump 8 employs a pair of hoppers, generally designated by the numeral 20, each of which is pivotably mounted over one of the charging barrels 12 and are shifted hydraulically (by associated cylinders 22) between filling and charging positions. Briefly, each of the hoppers 20 opens and closes to deposit its charge into the associated barrel 12, with its associated ram 24 in its fully withdrawn position. The barrels 12 are alternately unloaded by the action of the reciprocating feed rams 24, which are slideably mounted therein, with the movement of the hoppers 20 and ball 11 of the valve 10 occuring in timed sequence in response to movement of the rams 24. The details of the reciprocating pump section thus briefly described are set forth in a commonly assigned application for United States Letters Patent entitled "Reactor System and Pump Apparatus Therein", filed Jan. 12, 1979 in the names of Reginald Livingstone Burroughs, William James Thompson, and Derek Wooldridge, and bearing Ser. No. 2,886.

The outlet pipe 14 is connected to a buffer zone pipe section 26 which, in turn, is connected to an injection block, generally designated by the numeral 28. The block 28 is fitted with conduits 68, through which is injected steam, and with conduits 70, for acid injection and with conduits 72 for auxiliary water injection, if necessary.

In the preferred embodiment, auxiliary water is injected when hydrolyzing corn and other whole grains to achieve the desired reactor solids level. Pumping wetter grains initially is generally avoided to prevent clogging of the pump. From the injection block 28, the mixture of starchy material, acid, steam and water, when injected, is forced into the jacketed reaction zone 34, which is provided with means for hot oil circulation, to minimize heat losses and to ensure that the desired temperatures are maintained therein; the reactor also has instrumentation flanges 37 and oil jumpovers 39 at appropriate locations along its length. Adjacent the discharge end of the reaction zone 34 is a five-way cross 35, which is included to permit the incorporation of a rupture disk 36, an air leg 38, and a manual dump and clean out valve 40. The main process valve 42 is located downstream of the five-way cross 35, and is automatically operated through an appropriate loop circuit 41 to maintain the desired pressure in the reaction zone, by periodically opening to discharge material, and thereby to relieve the internal pressure.

The discharged material proceeds through a cooling section 44, which is provided to ensure that the temperature of the reaction mass is rapidly reduced, to thereby quickly terminate the reaction. Then the material passes through a valve 46, providing an alternate product discharge conduit, and ultimately into a product collection tank 48. The collection tank 48 is fitted with a condenser 50, by which vaporous products may be condensed and recovered; it also has a valved bottom discharge conduit 52, and cooling jacket 54, should it be necessary or desirable to lower the temperature of the product within the tank 48.

The above-described apparatus, in addition to use herein, is also suitable, without modification, for conversion of cellulosic materials into glucose as disclosed and claimed in said application Ser. No. 2,885 referred to hereinabove. Such interchangeability of starting materials offers versatility and optimum utilization to the user of the method and apparatus herein since it conveys the particularly valuable feature of allowing the manufacture of ethanol from a wide variety of natural and replenishable feedstocks.

EXAMPLE 1

Whole airdry corn was ground to 1/32 to 3/32 inches and mixed with water to form a free-flowing particulate mass containing about 60 percent of solids. The feedstock was forced into the continuous reactor equipped with a high solids reciprocating pump. Metered feeding was carried on at a rate of 1.32 pounds of dry corn solids per minute for a period of about 20 minutes after the reactor had been preheated to 176° C. with steam at 230 pounds per square inch pressure and brought to operating equilibrium. Sulfuric acid (at a concentration of 32.2 percent) was continuously injected near the point of steam introduction; it was charged at a rate sufficient to maintain a concentration of 1.44 percent, based on the total contents of the reactor and steam was injected at a rate sufficient to maintain the 176° C. temperature in the reaction zone. Auxiliary water was injected at a rate of 2.82 pounds per minute. After the addition of the steam, acid, and auxiliary water, the corn solids were present at a concentration of 17.2 percent. The rate of throughput of the reaction mass resulted in a residence time in the heated reaction zone of 3.4 minutes. A pressure valve at the discharge end of the reactor opened and closed in rapid cycles, relieving the hydrolyzed material through a cooling section of the system and into a receiving tank, which was equipped with a reflux condenser.

The hydrolyzate was neutralized with limestone to a pH of about 5, and filtered. Upon analysis, it was found that a glucose concentration of 9.3 percent had been produced, which corresponds to a recovery of 62 percent of the potential glucose (fed as starch in the corn). The resultant sugar solution is suitable for inoculation with yeast, to effect fermentation to ethanol.

EXAMPLE 2

Example 1 was repeated except that chopped 3/32 inch milo (grain sorghum) was mixed with water to form a mass at about B 65.5% overdry solids content. The feedstock was introduced at a rate of 2 pounds dry solids per minute, and sulfuric acid, at a concentration of 32.2 percent, was continuously injected near the point of steam introduction to maintain a concentration of 1.38 percent, based on the total contents of the reactor. Steam was injected at a rate sufficient to maintain a temperature of about 165° C. and a pressure of about 245 psig in the reaction zone. Auxiliary water was introduced at a rate of 2 pounds per minute. After the addition of the steam, acid, and auxiliary water the milo solids were present at a concentration of 26.4 percent. The rate of throughput of the reaction mass resulted in a residence time in the heated reaction zone of about 3.4 minutes.

The hydrolyzate was neutralized and found to contain a glucose concentration of 10.9 percent, corresponding to a recovery of 52 percent of the potential glucose fed as starch in the milo.

EXAMPLE 3

Example 1 was repeated except that whole unpeeled white potatoes were chopped to pass a ¾ inch screen and fed as is to the reactor at an ovendry solids concentration of 20.3 percent. Steam was injected at a rate sufficient to maintain a temperature of about 193° C. and a pressure of about 225 psig in the reactor. Sulfuric acid, after dilution, was present in a concentration of about 1.35 percent based on the total contents of the reactor. No auxiliary water was injected. After addition of steam and acid, the potato solids were present at a concentration of about 12.8 percent. The rate of throughput of the reaction mass resulted in a residence time of about 4.7 minutes.

The hydrolyzate was neutralized and found to contain a glucose concentration of about 8.0 percent, corresponding to a recovery of about 73 percent of the potential glucose fed as starch in the potatoes.

It will be seen that the present invention provides a novel process for the continuous saccharification of starchy materials, in which process the reaction times are relatively short. More specifically, the invention provides a process in which the starch constituents of typically low grade agricultural starchy materials may be converted, on a commercial basis, into glucose from which ethanol may be produced. In the process, utilization of high solids mixtures and short residence times maximizes economies, while also promoting the production of products of high market value. The control of water is also a very significant feature of the invention, particularly in regard to the high solids process; it must be provided in amounts which are stoichiometrically related to the starch content, for the hydrolysis reaction, and to provide feedstock mobility and high heat and reagent transfer rates, while also maintaining relatively high solids concentrations to maximize the overall economics of the process. Finally, the temperatures are so controlled as to promote high reaction rates without generating excessive pressures or promoting high levels of corrosion, while being selected to produce the products which are desired.

Having thus described the invention, what is claimed is:

1. A continuous process for the saccharification of whole grain to produce glucose comprising the steps of:

(a) substantially continuously introducing into one end of a tubular reactor and aqueous mixture of unpasted grain containing from about 50 to 65 weight percent solids, and constricting the other end of said reactor so as to develop a back pressure therein;

(b) substantially continuously injecting a strong mineral acid into said mixture in a concentration sufficient to catalyze the hydrolysis thereof;

(c) substantially continuously injecting steam and water into said mixture, at a location downstream from said one end of said reactor, to produce a reaction mass containing about 15 to about 35 weight percent solids; said steam being injected in an amount sufficient to maintain the temperature of said reaction mass at about 160° to 210° C.; and to thereby effect hydrolysis of said material in the presence of said acid;

(d) thereafter, substantially passing said reaction mass, into and through a reaction zone of said reactor located downstream from the steam and water injection location, the length of said reaction zone and the rate of mixture introduction being so selected as to afford an average residence time of about 1 to 10 minutes for each increment of said mass in said zone, and said back pressure therewithin being about 100 to 280 pounds per square inch; and (e) substantially continuously discharging said mass from said reactor.

2. The process of claim 1 wherein said whole grain product is corn, rice, barley, rye, milo, oats, millet, wheat or mixtures thereof.

3. The process of claim 1 wherein said acid is sulfuric acid.

4. The process of claim 1 including the additional step of neutralizing said hydrolyzate to a pH of about 4 to 7.

5. The process of claim 1 wherein said hydrolyzate is neutralized with calcium carbonate.

6. The process of claim 1 including the additional step of filtering said hydrolyzate to effect the removal of solids therefrom.

7. The process of claim 1 wherein said solids content is about 65 weight percent and said mineral acid is sulfuric acid.

* * * * *

UNITED STATES PATENT AND TRADEMARK OFFICE

CERTIFICATE OF CORRECTION

PATENT NO. : 4,318,748
DATED : March 9, 1982
INVENTOR(S) : John A. Church

It is certified that error appears in the above-identified patent and that said Letters Patent are hereby corrected as shown below:

At column 6, line 50, the phrase "about B 65.5% overdry solids" should read---about 65.5% ovendry solids---.

In claim 1, at column 8, line 2, "and" should be---an---.

Signed and Sealed this

*Twelfth* Day of *October 1982*

[SEAL]

*Attest:*

GERALD J. MOSSINGHOFF

*Attesting Officer*

*Commissioner of Patents and Trademarks*